US005105705A

United States Patent [19]

Drelinger

[11] Patent Number: 5,105,705

[45] Date of Patent: Apr. 21, 1992

[54] FLUTE HEADJOINT

[76] Inventor: Sanford Drelinger, P.O. Box 146, North White Plains, N.Y. 10603

[21] Appl. No.: 558,300

[22] Filed: Jul. 23, 1990

[51] Int. Cl.[5] ..... G10D 7/02

[52] U.S. Cl. ..... 84/384

[58] Field of Search ..... 84/380 R, 384

[56] References Cited

U.S. PATENT DOCUMENTS

| | | | |
|---|---|---|---|
| 2,195,992 | 4/1940 | Mausolf | 84/380 R |
| 3,062,084 | 11/1962 | Ogilvie | 84/384 |
| 3,866,507 | 2/1975 | Eajardo | 84/384 |
| 4,896,579 | 1/1990 | Goosman | 84/384 |

*Primary Examiner*—W. B. Perkey

*Assistant Examiner*—Cassandra C. Spyrou

*Attorney, Agent, or Firm*—Emmanuel J. Lobato

[57] ABSTRACT

A flute headjoint having a lip plate in which a portion of the blow edge is stepped to impart different heights to the blow hole. The blow hole has an inward protrusion beginning at the blow edge and extending the height of the blow hole to impart a region of narrower transverse dimension to the blow hole. Either feature, or both together, improve upper register performance. The edge of the lip plate opposite the lip rest surface is swept back toward the lip rest surface to minimize obstruction of excessive air flow. The blow hole features are incorporated in a piccolo embouchure including a tubular body of two halves.

21 Claims, 6 Drawing Sheets

FLUTE HEADJOINT

BACKGROUND OF THE INVENTION

The present invention relates to improvements in flute headjoints and headjoints for flute type instruments.

In this specification the term flute shall refer to thin-wall flute type instruments including flutes and piccolos, as well as flutes and piccolos which are hybrids between thin-wall and historic wall instruments.

The headjoint of a flute has a critical effect on the performance of the instrument. Even though the headjoint is mechanically simple, and does not even have any moving parts, it is an acoustically active body which can determine, and limit, the performance of the flute.

Various parameters characterize flute acoustic quality. These include upper and lower register performance and purity of tone. Typically, compromises must be made in the headjoint design in order to obtain an acceptable balance among these parameters. For example, upper register performance can be improved by making the blow hole height slightly shorter, but this will also result in a degradation of the lower register performance. Tonal quality can be improved by proper selection of the blow hole cross section and height, but it can be difficult to obtain good tonal quality across the entire range of the flute.

Various techniques have been tried in order to improve headjoint quality and flute performance. U.S. Pat. No. 3,866,507 issued Feb. 18, 1975 to J. R. Eajardo discloses a flute headjoint having a non-circular interior cross section with non-uniform wall thickness, and the blow hole canted relative to the radial dimension of the headjoint tube. If the blow hole is canted toward the air flow generated during flute play, then the blow hole wall beneath the blow edge will be longer than in the conventional blow hole design at the expense of the blow hole height beneath the lip edge. On the other hand, if the blow hole is canted away from the air flow to shorten the blow hole wall beneath the blow edge, this will be at the expense of the blow hole height beneath the under the lip edge. Either approach is a compromise which would be desirable to avoid.

Another technique for headjoint improvement is found in U.S. Pat. No. 4,896,579 issued Jan. 30, 1990 to J. P. Goosman. The disclosed headjoint has a conventional blow hole but seeks to reduce extraneous noise by a modified lip plate which the patent asserts channels away air which does not enter the blow hole. The part of the lip plate downstream from the blow hole is divided into two lobes which the patent describes as channelling the air flow between them. This structure cannot alter the inherent tonal range determined by the conventional blow hole.

It is an object of the invention to provide a flute headjoint with an improved range, and without loss of tonal quality.

It is another object of the invention to provide a flute headjoint with an improved range, and which retains the mechanical simplicity of conventional flute headjoints.

SUMMARY OF THE INVENTION

According to the invention a flute headjoint is comprised of a tubular headjoint body and a lip plate assembly. The tubular headjoint body is closed at one end and has an opposite open end for engagement with a flute body.

The lip plate assembly is comprised of a lip plate defining a lip rest surface, and a tubular riser having a bore open at both ends. The blow hole of the instrument extends through the lip plate and riser bore into the headjoint body. The upper blow hole opening adjacent the lip rest surface is defined by an edge, and the part of the edge opposite the lip rest surface is the blow edge.

The riser is attached to the side of the tubular headjoint body at a position where there is a hole through the headjoint body. The riser bore and the side hole through the headjoint body are in registration. Thus, during instrument play, air blown into the top of the blow hole flows through the riser bore and into the tubular headjoint body.

The blow edge has a stepped portion which is lower than the remainder of the blow edge. Consequently, the portion of the blow hole which is below the blow edge stepped portion is shorter than the rest of the blow hole for improvement in upper register performance without sacrifice of low register performance.

In addition to the stepped blow edge, the riser bore surface has a protrusion extending into the blow hole from the top to the bottom of the blow hole. A portion of the blow edge protrudes inwardly toward the lip rest surface, and this inward protrusion continues down the riser bore from the blow edge to the bottom opening. This gives the blow hole cross section a region of narrower transverse dimension and improves upper register performance without sacrificing the low register performance of the instrument.

DETAILED DESCRIPTION OF THE INVENTION

Figure 1:
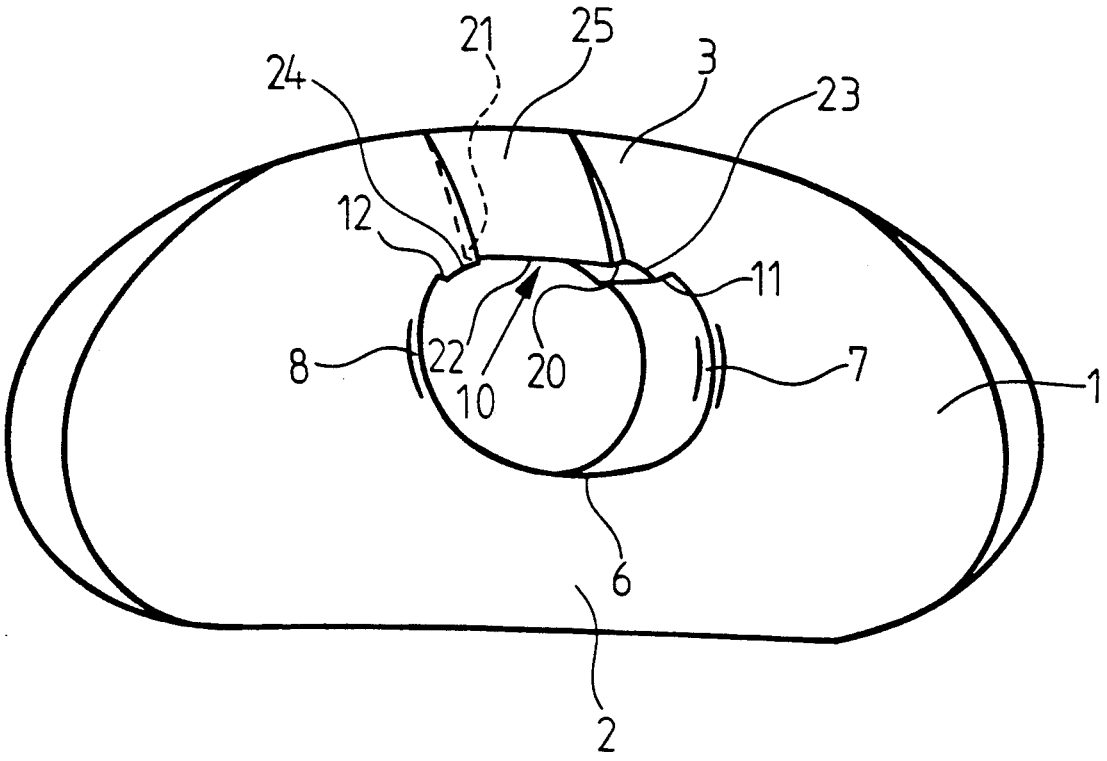
FIG. 1 is a top view of a lip plate assembly according to the present invention.

A preferred embodiment of a flute headjoint according to the invention is shown in FIG. 1. A lip plate assembly 1 has a central opening which constitutes the top of the blow hole of a flute when the lip plate assembly is finally incorporated into an instrument. The lip plate assembly 1 has a broad extent defining a lip-rest surface 2 facing the blow hole top and an opposite surface 3. The lip plate assembly will be described with reference to the orientation shown in FIG. 1 with left and right, and upper and lower taken as seen by a viewer of the drawing. The width of the blow hole top is the distance between the right and left side edges 7 and 8.

The blow hole is defined by various surfaces and edges which will now be described. The top of the blow hole is defined by the under the lip edge 6 which is the edge of the blow hole closest to the lip rest surface 2 of the lip plate assembly and which lies between the blow hole top right side edge 7 and the blow hole top left side edge 8. The under the lip edge 6 and the side edges 7, 8 merge smoothly and form a part of the blow hole top opening which is oblong in shape as is known. The portion of the blow hole top which is opposite the under the lip edge 6 is called the blow edge. The bore defining the blow hole has a bore surface having an oblong cross section. The blow edge 10 has various structural features which will be described in detail below. For now it should be noted that when an instrument is being played, air blown into the blow hole by the player strikes the blow edge 10 which has a critical effect on the performance of the instrument. The longer dimension of the blow hole cross section is aligned with the length dimension of the headjoint.

The transverse dimension of the top of the blow hole measured from the lip edge 6 to the blow edge 10 varies across the width of the blow hole. Two steps 11, 12 extend the blow edge inwardly of the blow hole so that the portion of the blow edge between the two steps 11, 12 protrudes into the blow hole toward the lip edge 6.

Figure 2:
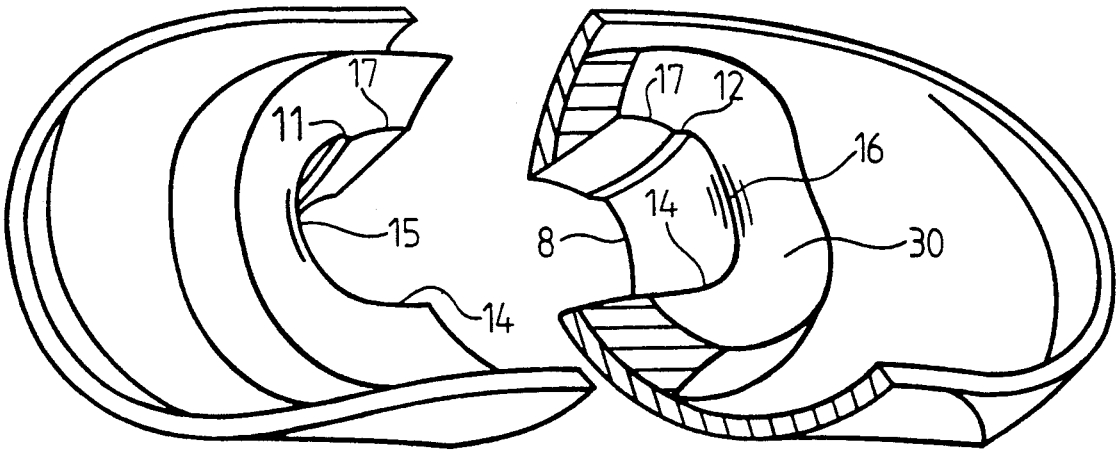
FIG. 2 is a bottom sectional view of the lip plate assembly shown in FIG. 1.

The blow hole bottom opening can be seen in FIG. 2. The blow hole bottom edge 14 lies below the lip edge 6. Similarly, the blow hole bottom right side edge 15 lies below the top right side edge 7, and the blow hole bottom left side edge 16 lies below the left side edge 8. The bottom right and left edges 15 and 16 appear to the left and right, respectively, in the drawing because the convention for left and right adopted for the top view results in a reversal of left and right when the lip plate assembly is viewed from the bottom.

The steps 11, 12 extend continuously from the top to the bottom of the blow hole. As a consequence, the protrusion between the steps 11, 12 extends along the entire height of the blow hole. Consequently, an instrument having this blow hole structure will exhibit better performance in the upper registers than an instrument having a conventional blow hole structure. This improvement in performance can be achieved without compromising the low register performance.

Referring back to FIG. 1, the portion 25 of the lip plate upper surface proximate the middle part of the blow edge 10 is depressed relative to the rest of the surface portion 3. A downward step 20, and a second step 21 which is shown by dashed lines, divides the part of the blow edge 10 between the steps 11 and 12 into a middle part 22, a right part 23 and a left part 24. The middle part 22 of the blow edge lies below the left and right parts 23, 24 by a distance equal to the height of the step 20. The part 25 of surface portion 3 between the two steps 20 and 21 tapers up toward the level of surface portion 3 in a direction away from the blow edge 10. The resulting ramp structure provides a smooth transition from the lower middle part 22 of the blow edge up to the level of the surface portion 3.

The height of the blow hole between the center part 22 of the blow edge and the blow hole bottom opening edge 17 which is below the blow edge 10 is less than the rest of the blow hole. This shortening of the blow hole height in the area beneath the edge portion 22 is effective to enhance the performance of the instrument in the upper register, again without compromising the performance in the lower register.

In one satisfactory embodiment of a C concert flute headjoint the protrusion width between steps 11, 12 was approximately 0.325 inches, the height of steps 11, 12 was approximately 0.020 inches, the width of portion 25 was approximately 0.250 inches, and the height of steps 20, 21 was approximately 0.010 inches at the blow edge. This combination of dimensions gave excellent results.

Figure 3:
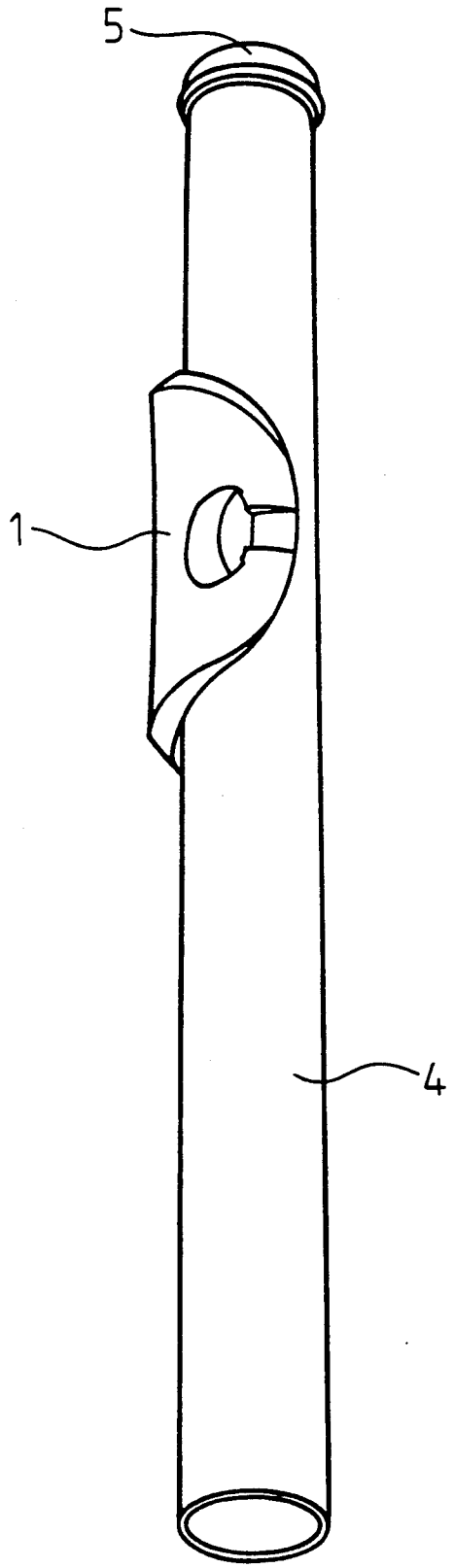
FIG. 3 is a plan view of a headjoint having the lip plate assembly shown in FIGS. 1 and 2.

FIG. 3 shows the lip plate assembly 1 according to the invention mounted on a headjoint tube 4 in the conventional manner. One end of the headjoint tube 4 is closed by a closure 5 as is conventional, and the opposite end of the tube 4 is open for attachment to a flute body.

Figure 4:
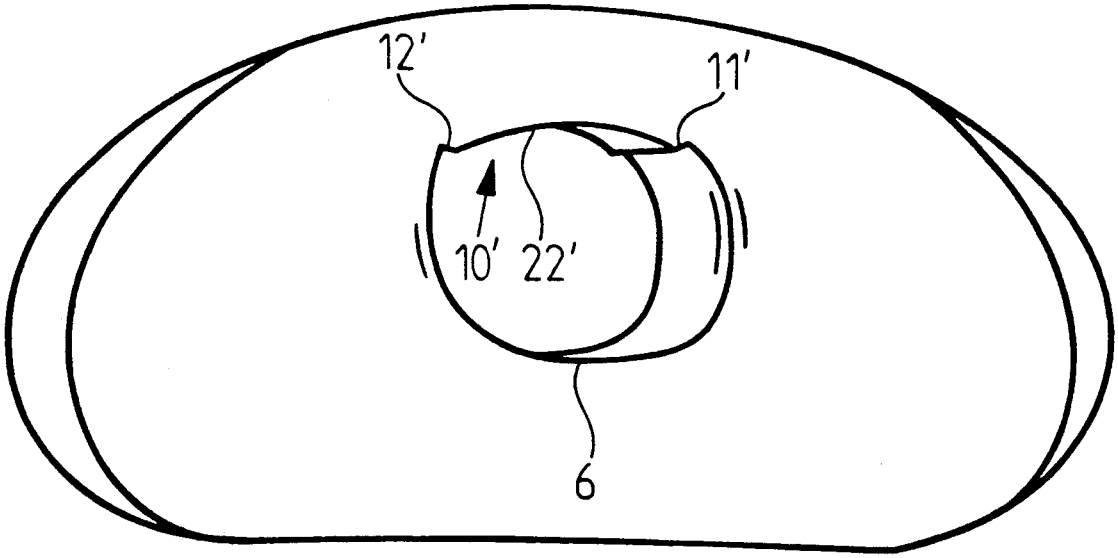
FIG. 4 is a top view of another embodiment of a lip plate assembly according to the invention.

FIG. 4 shows an embouchure plate according to the invention having steps 11', 12' which extend part 22' of the blow edge closer to the lip edge 6 than the rest of the blow edge 10'. This embodiment of the invention does not have structure corresponding to the steps 20, 21 so that the part 22' of the blow edge between the steps 11', 12' is unbroken. The height of the blow hole is more or less the same throughout.

Figure 5:
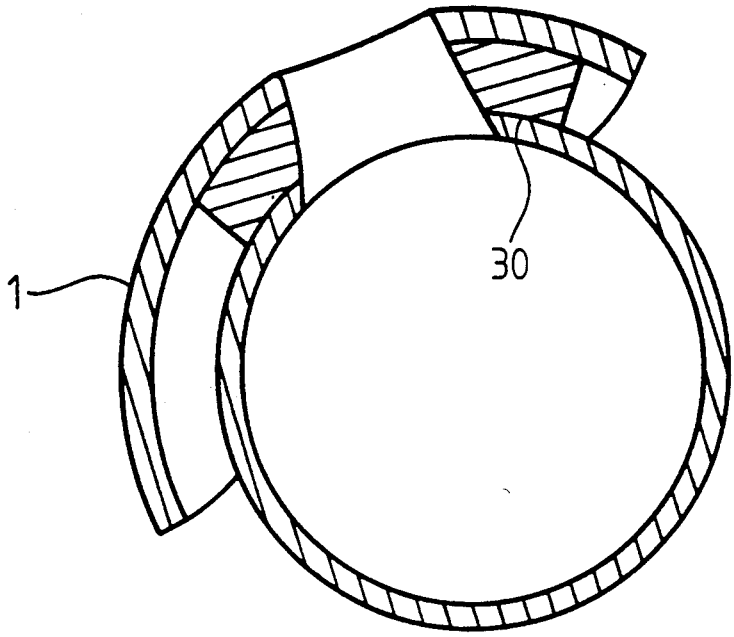
FIG. 5 is a cross section of the lip plate assembly shown in FIG. 1.

The annular surface 30 surrounding the edges 14–17 of the blow hole bottom opening sits on the outer wall of the instrument tube as shown in FIG. 5. This structure is conventional. In it, the junction of the surface 30 and the instrument tube is shaped after they are joined to form a smooth transition from the blow hole bottom opening into the instrument tube. This transition region is referred to as the undercut.

Figure 6:
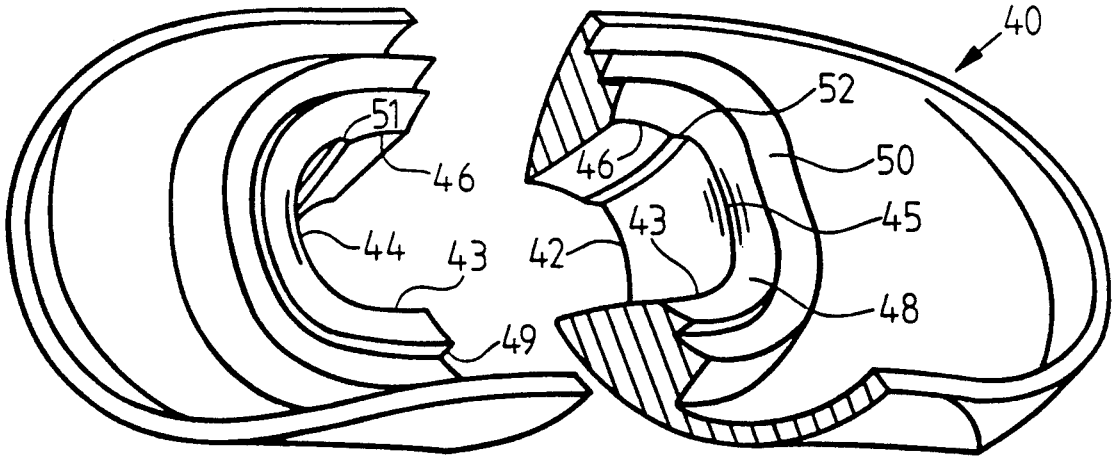
FIG. 6 is a bottom view of another lip plate assembly.

FIG. 6 shows an embodiment which has the entire undercut formed on it. As such, it incorporates features covered by my U.S. Pat. Nos. 4,550,637 and 4,800,635. The lip plate assembly 40 has a blow hole bottom opening with under the lip bottom edge 43, bottom opening right edge 44 and left edge 45, and bottom edge 46 which is under the blow edge. The annular surface 48 surrounding the edges 43–46 of the blow hole bottom opening constitutes a segment of the tubular headjoint body and contains the undercut. The surface 48 is bounded by an annular step 49 and a second annular surface 50.

Figure 7:
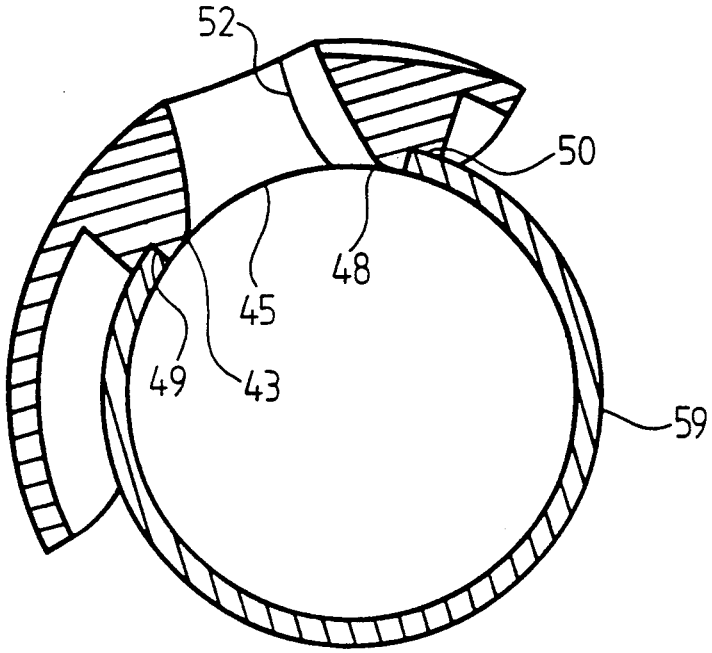
FIG. 7 is a cross section of the lip plate assembly shown in FIG. 6.

The annular surface 50 corresponds to the surface 30 shown in FIG. 5 and provides a seat which engages the instrument tube. The engagement of the lip plate assembly and the instrument tube can be seen in FIG. 7 which shows how the surface 50 sits on the outer wall of the instrument tube so that the undercut on the surface 48 is positioned to provide the smooth transition from the bottom opening of the blow hole into the instrument tube 59.

The steps 51, 52 (FIG. 6) extend from the blow edge down to the undercut. Because the undercut is an integral part of the lip plate assembly there will be no alteration of the blow hole transverse dimensions when the lip plate assembly is mounted on the instrument tube wall. Therefore, the effect of the inwardly projecting blow hole wall between the steps 51, 52 will not be diminished as it can be in the case of an instrument in which the undercut is formed after lip plate assembly mounting.

Figure 8:
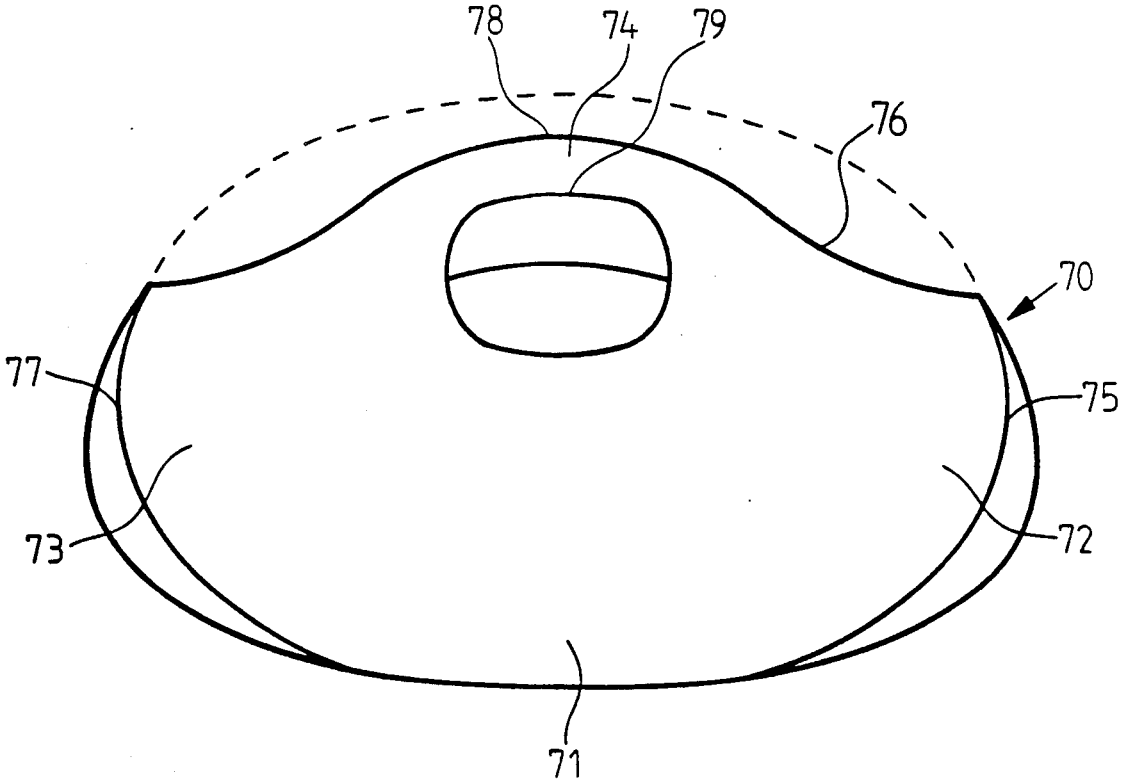
FIG. 8 is a top view of another lip plate assembly.

FIG. 8 illustrates another feature of an improved lip plate assembly 70. The lip plate assembly 70 includes a lip rest surface portion 71 flanked by broadly extending right and left side surface portions 72, 73, respectively. A surface portion 74 on the opposite side of the blow hole from the lip rest surface 71 surrounds the blow hole opening. The surface portion 74 is bounded by an outer edge 78 which is adjacent the blow edge 79.

The right and left side surface portions 72, 73 are bounded by edges 75, 77 which continue around toward the surface portion 74 to merge with the outer edge 78. Conventionally, the edges 75, 77 continue in a generally convex oval path toward the surface portion 74 as shown by the dashed line. In the lip plate assembly according to the invention the right edge 75 continues from the surface portion 74 along a path which does not go forward of the outer edge 78 as in the conventional shape shown in dotted line. The left edge 77 also approaches the surface portion 74 along a path which does not go forward of the outer edge 78. The result is a lip plate which has an edge 76 opposite the lip rest surface 71 which is progressively swept back behind the blow edge toward the main portion of the lip rest the further the edge 76 is from the blow hole.

It has been found that the conventional surface portions which are bounded by the dashed lines impart resistance to excess or exhaust air flowing over the upper surface of the lip plate, and this gives rise to undesirable acoustical activity which can be heard as noise. Accordingly, the outer edge 78 should be as close to the blow edge 79 as possible and limited by structural requirements of the lip plate assembly. This feature also permits a significant reduction in material, which is economically important if the instrument is made from precious metal.

Figure 9:
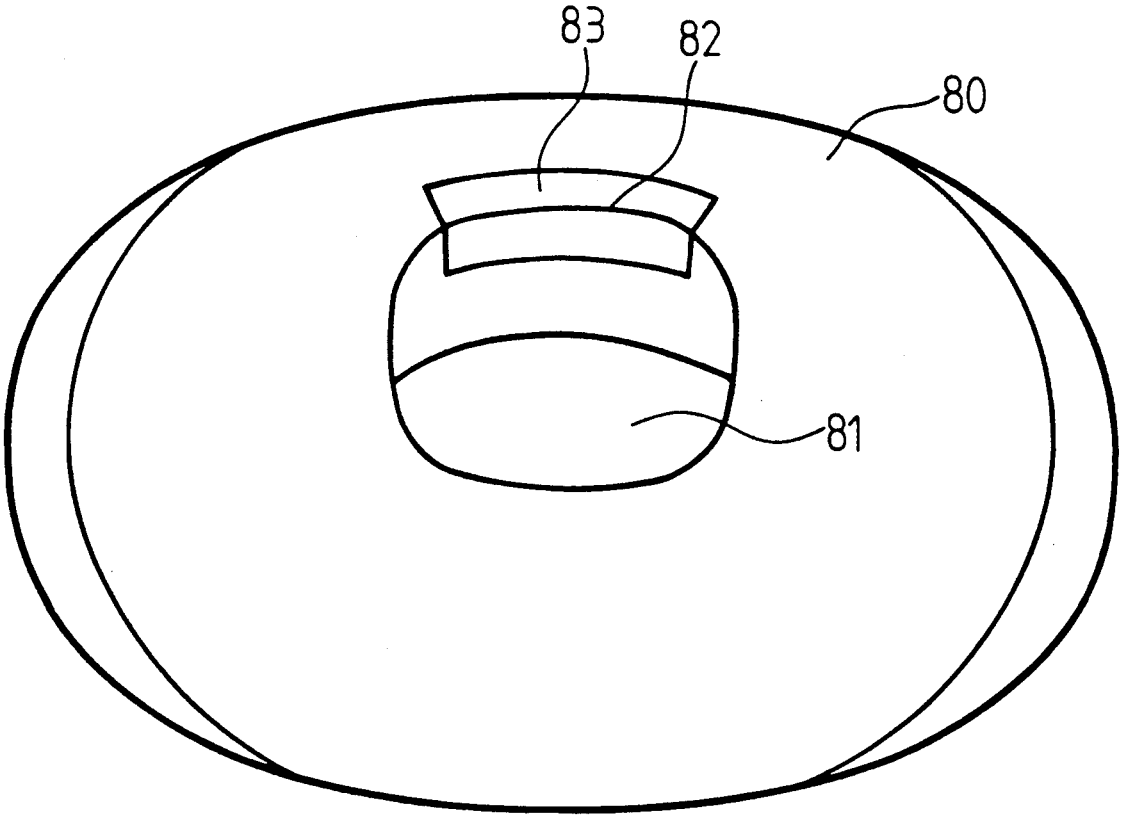
FIG. 9 is a top view of still another lip plate assembly.

As shown in FIG. 9, the lip plate 80 has a blow hole 81 with a blow edge 82 defined by part of the upper opening of the blow hole. An insert 83 of a material which is different from the material of the riser and the remainder of the lip plate borders the upper opening of the blow hole 81 and contains a substantial part of the blow edge 82. The material of the insert 83 is selected to achieve good acoustic quality which might not be achieved with the material from which the lip plate 80 is made. For example, the insert 83 could be a gold alloy while the lip plate 80 is a much less expensive metal. As another example, the insert 83 could be made of metal or a hard synthetic material and embedded in a wooden embouchure. In any case, a blow edge on insert 83 can incorporate the various improvements already described.

I claim:

1. A flute headjoint, comprising:

a tubular headjoint body having a closed end and an opposite open end;

a lip plate assembly mounted on the side of said tubular headjoint body, said lip plate assembly comprising a tubular riser having a bore defining a blow hole, the riser bore having an external open end and an internal open end opening into said tubular headjoint body, and the riser bore defined by a riser bore surface having an oblong cross section with a longer dimension aligned with a length dimension of said tubular headjoint body, and said riser bore surface having a protrusion into said blow hole beginning at said blow edge and extending all the way down said riser bore surface to the bottom opening of the blow hole, a lip plate proximate the blow hole external open end for defining a lip plate rest surface adjacent the blow hole, an edge of the blow hole external open end opposite the lip plate rest surface defining a blow edge against which air strikes during instrument plate and is directed through said tubular riser into said tubular headjoint body; and said blow edge having a portion lower than the remainder of said blow edge for imparting an effective height to the blow hole at said lower portion which is shorter than the height of the remainder of said blow hole.

2. A flute headjoint according to claim 1, wherein a bottom of said riser defines a tubular segment constituting a portion of said tubular headjoint body, the blow hole bottom opening opening at said tubular segment, and said tubular segment containing an entire undercut surface.

3. A flute headjoint, comprising a tubular headjoint body having a closed end and an opposite open end; and a lip plate assembly mounted on a side of said tubular headjoint body, said lip plate assembly comprising a tubular riser having a bore defining a blow hole, the riser bore having an external open end and an internal open end opening into said tubular headjoint body, and a lip plate proximate the blow hole external open end for defining a lip rest surface adjacent the blow hole, an edge of the blow hole external open end opposite the lip rest surface defining a blow edge against which air strikes during instrument play and is directed through said tubular riser into said tubular headjoint body, said lip plate having an upper surface proximate said blow edge and side surface portions flanking the blow hole top opening, said upper surface bounded by an outer edge adjacent said blow edge and extending progressively swept back behind the blow edge toward said lip rest surface at progressively greater distances of the edge from the blow hole top opening for minimizing obstruction to excess air flow during flute play.

4. A flute headjoint according to claim 3, wherein said blow edge has a portion lower than a remainder of said blow edge for imparting an effective height to the blow hole at said lower portion which is shorter than a height of the remainder of said blow hole.

5. A flute headjoint according to claim 4, wherein the bore through said riser is defined by a riser bore surface having an oblong cross section with its longer dimension aligned with the length dimension of said tubular headjoint body;

said riser bore surface having a protrusion into said blow hole beginning at said blow edge and extending all the way down said riser bore surface to the bottom opening of the blow hole.

6. In a flute headjoint having a tubular body having a closed end and an opposite open end, and means defining a blow hole with an outer opening with a blow edge, the improvement comprising:

the blow hole defined by a bore surface having an oblong cross section with a longer dimension aligned with a length dimension of the tubular headjoint body; and said bore surface having a protrusion into said blow hole beginning at said blow edge and extending all the way down said bore surface to the bottom of said blow hole.

7. A flute headjoint, comprising:

a tubular headjoint body having a closed end and an opposite open end;

a lip plate assembly mounted on the side of said tubular headjoint body, said lip plate assembly comprising a tubular riser having a bore defining a blow hole, the riser bore having an external open end and an internal open end opening into said tubular headjoint body, and a lip plate proximate the blow hole external open end for defining a lip rest surface adjacent the blow hole, an edge of the blow hole external open end opposite the lip rest surface defining a blow edge against which air strikes during instrument play and is directed through said tubular riser into said tubular headjoint body;

said blow edge having a portion lower than a remainder of said blow edge for imparting an effective height to the blow hole at said lower portion which is shorter than a height of the remainder of said blow hole;

a bottom of said riser defining a tubular segment constituting a portion of said tubular headjoint body, a blow hole bottom opening opening at said tubular segment, and said tubular segment containing an entire undercut surface;

the bore through said riser being defined by a riser bore surface having an oblong cross section with its longer dimension aligned with a length dimension of said tubular headjoint body; and said riser bore surface having a protrusion into said blow hole beginning at said blow edge and extending all the way down said riser bore surface to the bottom opening of the blow hole.

8. A flute headjoint according to claim 7, wherein said lip plate has an upper surface proximate said blow edge and side surface portions flanking a blow hole upper opening, said upper surface bounded by an outer edge adjacent said blow edge and extending progressively swept back behind the blow edge toward said lip rest surface progressively greater distances of the edge from the blow hole top opening for minimizing obstruction to excess air flow during flute plate.

9. In a tubular headjoint having a closed end and an opposite open end, and having an embouchure with a blow hole, an outer opening of said blow hole circumscribed by an edge including the blow edge of the instrument, the improvement comprising:

an insert bordering a portion of the outer opening of said blow hole and containing a substantial part of the blow edge; and said insert comprising a material which is different from a material from which said embouchure is made.

10. In a headjoint according to claim 9, said blow edge having a portion lower than the remainder of said blow edge for imparting an effective height to the blow hole at said lower portion which is shorter than a height of the remainder of said blow hole.

11. In a headjoint according to claim 9, said blow hole defined by a bore surface having an oblong cross section with a longer dimension aligned with a headjoint length; and said bore surface having a protrusion into said blow hole beginning at said blow edge and extending a entire length of said bore surface to the bottom of the blow hole.

12. A flute headjoint, comprising:

a tubular headjoint body having a closed end and an opposite open end; and a lip plate disposed on said tubular headjoint body and comprising a body of material having a smooth upper surface with a blow hole formed therein, the blow hole being defined by an edge including a blow edge portion against which air strikes during instrument plate, and said upper surface having a lip rest portion adjacent the blow hole and opposite said blow edge; and said upper surface bounded by an outer edge of said body of material, said outer edge having a locus adjacent said blow edge and extending progressively swept back in a concave path behind said blow edge toward said lip rest surface at progressively greater distances of said outer edge from the blow hole for reducing an amount of material in said lip plate.

13. A flute headjoint according to claim 12, wherein the body of material comprising the lip plate consists essentially of precious metal.

14. A flute headjoint according to claim 13, further comprising:

an insert bordering a portion of said edge defining the blow hole and containing a substantial part of said blow edges; and said insert comprising a material which is different than said material from which said lip plate is made.

15. A flute headjoint, comprising:

a tubular headjoint body having a closed end and an opposite open end; and a lip plate disposed on said tubular headjoint body and comprising a body of material having a smooth upper surface with a blow hole formed therein, the blow hole being defined by an edge including a blow edge portion against which air strikes during instrument plate, and said upper surface having a lip rest portion adjacent the blow hole and opposite said blow edge; and said upper surface bounded by an outer edge of said body of material, said outer edge having a locus adjacent said blow edge and extending progressively swept back in a concave path behind said blow edge toward said lip rest surface at progressively greater distances of said outer edge from the blow hole for (i) minimizing an amount of material in the lip plate forward of said lip rest surface and for (ii) minimizing obstruction to exhaust air flow during flute play.

16. A flute headjoint according to claim 15, wherein the body of material comprising the lip plate consists essentially of precious metal.

17. A flute headjoint according to claim 15, further comprising:

an insert bordering a portion of said edge defining the blow hole and containing a substantial part of said blow edge; and said insert comprising a material which is different than said material from which said lip plate is made.

18. In a flute headjoint having respective closed and open ends, a blow hole with a blow edge and means defining a lip rest surface adjacent the blow hole and opposite the blow edge, the improvement comprising:

an external surface portion bounded by an outer edge, said outer edge having a locus adjacent said blow edge and extending progressively swept back in a concave path behind said blow edge toward said lip rest surface at progressively greater distances of said outer edge from the blow hole for minimizing obstruction to exhaust air flow during flute play.

19. In a flute headjoint according to claim 18, the improvement further comprising:

an insert bordering a portion of said edge defining the blow hole and containing a substantial part of said blow edge;

said insert comprising a material which is different than said material from which said lip plate is made.

20. A flute headjoint according to claim 12, further comprising a riser between said lip plate and said tubular headjoint body, said riser having a tubular bore opening at said blow hole and opening into said tubular headjoint body, and a bottom of said riser containing an entire undercut surface.

21. A flute headjoint according to claim 15, further comprising a riser between said lip plate and said tubular headjoint body, said riser having a tubular bore opening at said blow hole and opening into said tubular headjoint body, and a bottom of said riser containing an entire undercut surface.

* * * * *